US008566988B2

(12) United States Patent
Son et al.

(10) Patent No.: US 8,566,988 B2
(45) Date of Patent: Oct. 29, 2013

(54) MATTRESS STRUCTURES FOR CHILD CONTAINMENT AND SLEEPING DEVICES

(75) Inventors: Ernest Son, Atlanta, GA (US); Matthew Rivera, Mableton, GA (US); Melissa Wolf, Roswell, GA (US); Brandon Burkholder, Atlanta, GA (US); James Dorsey, Smyrna, GA (US)

(73) Assignee: Graco Children's Products Inc., Atlanta, GA (US)

( * ) Notice: Subject to any disclaimer, the term of this patent is extended or adjusted under 35 U.S.C. 154(b) by 147 days.

(21) Appl. No.: 13/113,836

(22) Filed: May 23, 2011

(65) Prior Publication Data

US 2011/0283457 A1 Nov. 24, 2011

Related U.S. Application Data

(60) Provisional application No. 61/346,904, filed on May 21, 2010.

(51) Int. Cl.
*A47C 17/00* (2006.01)

(52) U.S. Cl.
USPC ..... 5/690; 5/93.1; 5/99.1

(58) Field of Classification Search
USPC ..... 5/93.1, 98.1, 99.1, 722, 723, 690, 691, 5/417, 420, 655
See application file for complete search history.

(56) References Cited

U.S. PATENT DOCUMENTS

| | | | | |
|---|---|---|---|---|
| 6,434,767 | B1 * | 8/2002 | Welsh, Jr. | 5/93.2 |
| 6,438,773 | B1 * | 8/2002 | Hsia | 5/99.1 |
| 7,752,693 | B2 | 7/2010 | Espenshade | |
| 2007/0214576 | A1 * | 9/2007 | Espenshade | 5/723 |
| 2007/0271697 | A1 * | 11/2007 | Martin | 5/93.2 |
| 2009/0077740 | A1 * | 3/2009 | Jackson et al. | 5/93.1 |

OTHER PUBLICATIONS

Owner's Manual Graco Pack N Play (2002).

* cited by examiner

*Primary Examiner* — Robert G Santos
*Assistant Examiner* — Richard G Davis
(74) *Attorney, Agent, or Firm* — Lempia Summerfield Katz LLC

(57) ABSTRACT

A mattress pad assembly for use with a child containment area is disclosed. The mattress pad assembly includes a mattress pad having a plurality of panels each of which is coupled to at least one other panel along a flexible seam, wherein the mattress pad is reconfigurable between a non-planar configuration and a planar configuration defined by the cooperation of the plurality of panels to form a flexible top surface and a substantially rigid bottom surface. The mattress pad assembly further includes a support assembly coupled to the bottom surface of the mattress pad when the mattress pad is in the planar configuration, the support assembly having one or more support connectors coupled to at least two of the plurality of panels, and a brace configured to removably cooperate with the one or more support connectors, wherein the brace is configured to engage each of the plurality of panels to prevent bending along the flexible seam.

7 Claims, 9 Drawing Sheets

MATTRESS STRUCTURES FOR CHILD CONTAINMENT AND SLEEPING DEVICES

PRIORITY CLAIM

This patent document claims the priority benefit provided under 35 U.S.C. §119(e) to U.S. Provisional Patent Application Ser. No. 61/346,904 filed on May 21, 2010. The entire content of this prior application is expressly incorporated herein for all purposes to the extent permitted by law.

TECHNICAL FIELD

This patent document generally relates child containment and sleeping devices and more particularly to child containment and sleeping devices configured and adapted to maintain a planar play and/or sleeping surface.

BACKGROUND

Known child containment devices, playpens, portable cribs, playards, and other similar products tend to be difficult to transport and disassemble. These difficulties can be enhanced by the variety and number of accessories and options that may be attached or utilized with these products. Playards and other similar products in this category often include one or more features or accessories such as a bassinet, elevated infant sleep area and/or an infant changing table or surface. These features or accessories, while providing for additional versatility and customization, add weight and complexity to the product and further limit portability.

Child containment devices, playpens, portable cribs and playards often utilize a conventional mattress pad that incorporates a structure comprising a plurality of panels made from a sturdy but heavy material. Each of the panels, in turn, are sewn into the fabric mattress cover and separated by a fabric seam. This construction, while durable, prevents removal of the panels and can be heavy. On many of these types of units, the mattress can fold to surround the exterior of the collapsed frame assembly of the product and in this way is portable with the unit. The relatively heavy mattress adds additional weight to the portable unit.

Construction of a mattress pad involves selection of an outer fabric layer of material based on decoration, durability, wear resistance, stain resistance, comfort, and the like. A pad or cushion material is provided beneath the outer layer and is supported by a base or structural material. While this construction may help sustain the individual panels in a substantially flat and planar condition, the mattress pad as a whole can flex and bends along the flexible seam resulting in an irregular and non-flat mattress surface.

SUMMARY

The patent disclosure discussed and described herein provides for mattress structures that maintain a substantially flat and planar top surface of a mattress pad. Moreover, the patent disclosure discussed and described herein maintains the substantially flat and planar top surface without a substantial change or increase in the overall device weight or complexity.

In one embodiment, a mattress pad assembly for use with a child containment area is disclosed. The mattress pad assembly includes a mattress pad having a plurality of panels, each of which is coupled to at least one other panel along a flexible seam, whereby the mattress pad is reconfigurable between a non-planar configuration and a planar configuration defined by the cooperation of the plurality of panels to form a flexible top surface and a substantially rigid bottom surface. The mattress pad assembly further includes a support assembly coupled to the bottom surface of the mattress pad when the mattress pad is in the planar configuration. The support assembly has one or more support connectors coupled to at least two of the plurality of panels, and a brace configured to removably cooperate with the one or more support connectors, wherein the brace is configured to engage each of the plurality of panels to prevent bending along the flexible seam.

In another embodiment, a mattress pad assembly for use with a child containment area is disclosed. The mattress pad assembly includes a mattress pad having a plurality of panels each of which is coupled to at least one other panel along a flexible seam. The mattress pad is reconfigurable between a non-planar configuration and a planar configuration defined by the cooperation of the plurality of panels to form a flexible top surface and a substantially rigid bottom surface. The mattress pad assembly further includes or incorporates a brace sized to compliment a width of one of the plurality of panels, and a guide arranged along the width of the panel and substantially perpendicular to the flexible seam coupling two of the plurality of panels. The guide cooperates with the substantially rigid bottom surface of the mattress pad to form a channel. The channel is sized to carry the brace, and the brace is moveable between a stowed position within the channel and a deployed position configured to engage each of the plurality of panels to prevent bending along the flexible seam.

In yet another embodiment, a mattress pad assembly for use with a child containment area is disclosed. The mattress pad assembly includes a mattress pad having a plurality of panels, each of which is coupled to at least one other panel along a flexible seam. The mattress pad is reconfigurable between a non-planar configuration and a planar configuration defined by the cooperation of the plurality of panels to form a flexible top surface and a substantially rigid bottom surface. A first brace is secured adjacent to the flexible seam, wherein the first brace is rotatable between an aligned position parallel to the flexible seam and an in-use position that prevents bending along the flexible seam.

In yet another embodiment, a mattress pad support assembly for use in cooperation with a child containment area is disclosed. The mattress pad support assembly includes a bassinet having a substantially planar rectilinear base. The base includes a top surface sized to support a flexible mattress pad. At least one flexible support channel is affixed to a bottom surface of the base. At least one support panel sized to slideably cooperate with the at least one flexible support channel, wherein the at least one support panel is configured to prevent flexure in the mattress pad supported by the substantially planar rectilinear base.

Other embodiments are disclosed, and each of the embodiments can be used alone or together in combination. Additional features and advantages of the disclosed embodiments are described in, and will be apparent from, the following Detailed Description and the figures.

DETAILED DESCRIPTION

The present disclosure provides numerous examples and embodiments of mattress pad assemblies and mattress pad support mechanisms that ensure or maintain a substantially flat (i.e., planar) top surface of the mattress pad. In one embodiment, the mattress pad assembly includes one or more connectors affixed to a bottom surface of the mattress pad and configured to cooperate with one or more brace to prevent flexure between the individual panels of the mattress pad. In another embodiment, the mattress pad assembly includes a segmented brace which may or may not cooperate with a c-channel guide secured to the bottom surface of the mattress pad. The segmented brace is slideable or shiftable between a stowed position and an in-use position and arranged to prevent bending along a flexible seam joining two of the panels that make up the mattress pad. In yet another embodiment, a brace is secured adjacent to a flexible seam and pivotable about a pivot point from a position parallel to the flexible seam joining two of the panels of the mattress pad to a position perpendicular to the flexible seam. In another embodiment, a mattress support assembly is an integral portion of a bassinet or other accessory configured to cooperate with a known playard or other child containment device. The mattress support assembly, in this embodiment, accepts and carries one or more support panels within a channel or pocket defined between a bottom or base surface of the bassinet and an inner surface of the channel or pocket.

Figure 1:
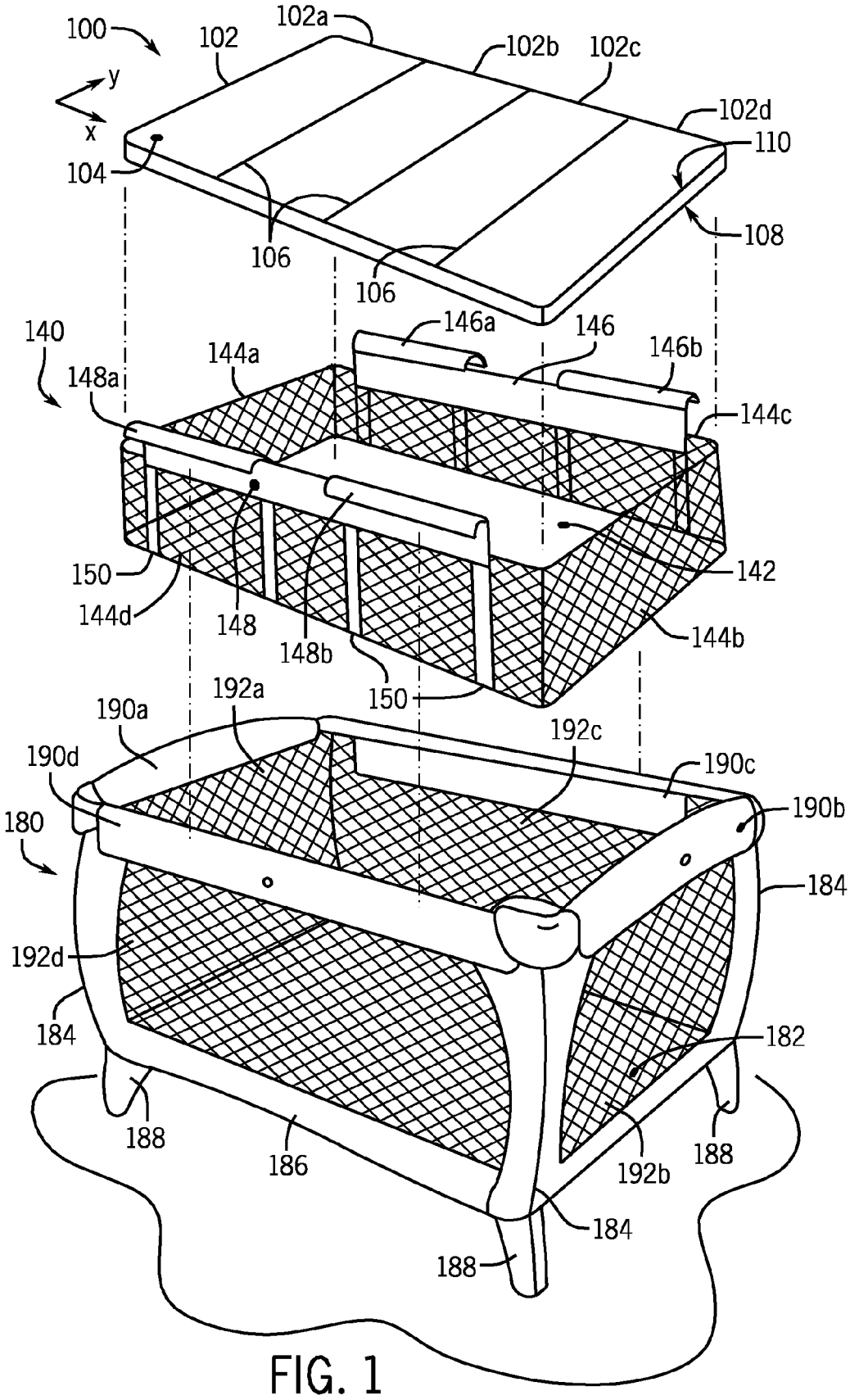
FIG. 1 illustrates an exploded perspective view of a child containment and play system including a mattress pad, a bassinet and a playard.

FIG. 1 is an exploded perspective view of an exemplary mattress pad assembly 100 arranged above a bassinet 140 and child containment system or playard 180. The mattress pad assembly 100 in the disclosed example includes a multi-paneled mattress pad 102. The multi-paneled mattress pad 102 (referred to hereinafter as "the mattress pad 102") as illustrated herein can be carried or supported by a base surface 142 of the bassinet 140. Alternatively, the mattress pad 102 can be carried or supported by a base surface 182 of the playard 180. Further details and specific features and configurations of the mattress pad assembly 100 and associated structures are discussed and described in greater detail below. The mattress pad assembly 100 disclosed herein is suitable for use in children's play or sleep products such as the above-mentioned devices, and is particularly well suited to provide a planar and substantially flat mattress surface 104. The planar and substantially flat mattress surface 104, in turn, provides a safe and comfortable infant or child sleeping and play surface.

The exemplary child containment system or playard 180 shown in FIG. 1, is generally known in the art and typically includes a bottom frame structure 186 that interconnects four corner legs 184. Each corner leg 184 includes a foot 188 configured to support the playard 180 and interface with a floor surface. As generally shown in FIG. 1, each of the corner legs 184 interconnects and cooperates with the bottom frame structure 186 substantially adjacent to it's respective foot 188. The corner legs 184 further interconnect and cooperate with a top frame structure 190 positioned distal to the bottom support frame 186. The top support frame 190 includes top links individually identified by the reference identifiers 190*a* to 190*d*. In this exemplary embodiment, the top and bottom frame structures 186 and 190 define a substantially rectilinear support structure typified by the rectilinear base surface 182. For example, the top links 190*a* and 190*b* are congruent sides that correspond to the short sides of the rectilinear base surface 182. Similarly, the top links 190*c* and 190*d* are congruent sides (each of which is arranged at a substantially right angle to the top links 190*a* and 190*b*) that correspond to the long sides of the rectilinear base surface 182. It will be understood by one of ordinary skill that the configuration and layout of the bottom support frame 186 (and in particular, the links or components that make up the bottom support frame 186) mirror the top support frame 190. The corner legs 184 and the support frames 186 and 190, in this exemplary embodiment, are padded and covered by an overlapping fabric to protect the infant or child from injury or other harmful contact with the structure of the playard 180.

The playard 180 further includes sidewalls 192 (individually identified as sidewalls 192*a* to 192*d*) supported between the top support frame 190 and the bottom support frame 186. The sidewalls 192, in this embodiment, are fabric, nylon, or mesh side panels. As shown in FIG. 1, the sidewalls 192 cooperate with the base surface 182 to define an enclosure or contained area suitable for an infant or child.

FIG. 1 further illustrates the bassinet 140 arranged above, and sized to be supported within, the playard 180. The bassinet 140, as with the playard 180, is a substantially rectilinear structure defined by the sidewalls 144*a* to 144*d*. The sidewalls 144*a* and 144*b* are congruent sides that correspond to the short sides of the rectilinear base surface 142, while the sidewalls 144*c* and 144*d* correspond to the long sides of the rectilinear base surface 142. In this embodiment, the bassinet 140 does not include a top support frame such as the top support frame 190. However, in other embodiments, a top support frame may be included to provide additional support and structural integrity.

Figure 2:
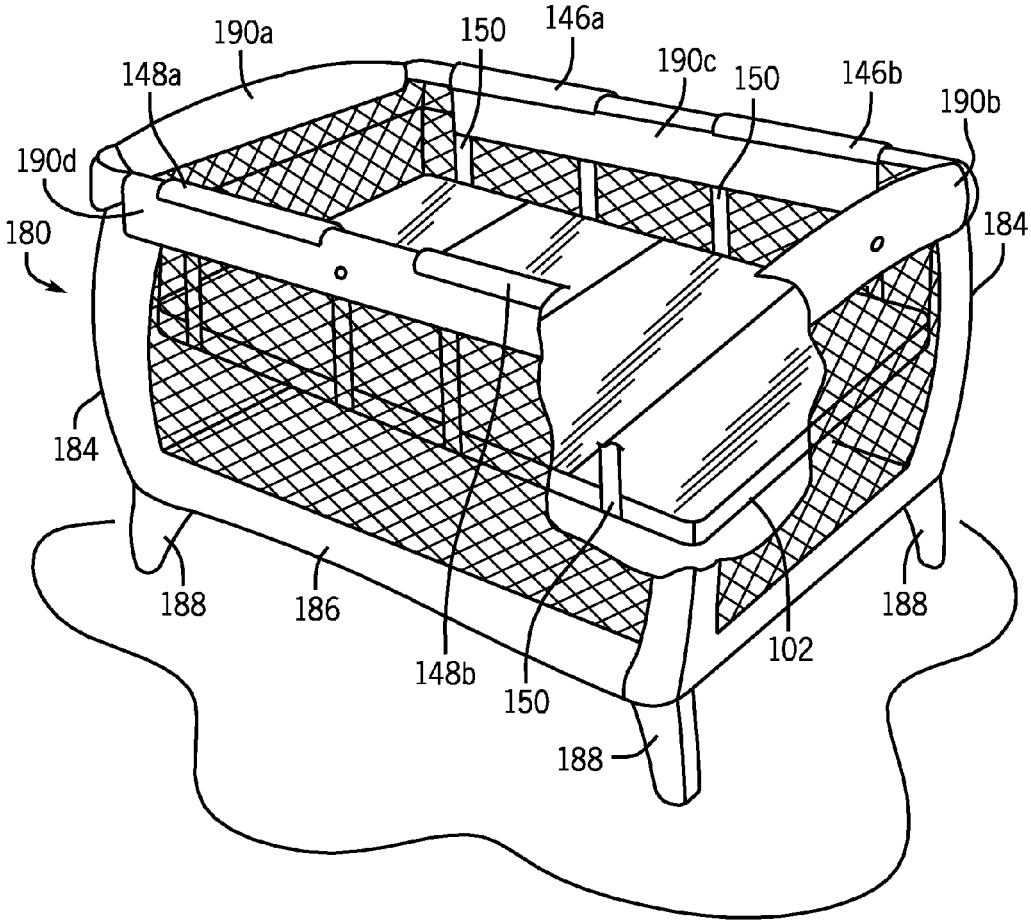
FIG. 2 illustrates an assembled perspective view of the child containment and play system shown in FIG. 1.

The bassinet 140 further includes support rails 146 and 148. The rails 146 and 148 are affixed to the sidewalls 144*c* and 144*d*, respectively. Each of the rails 146 and 148 includes a pair of curved hangers (individually identified as the hangers 146*a* and 146*b*, and 148*a* and 148*b*) configured to cooperate with the top links 190*c* and 190*d* of the top support frame 190 as shown in FIG. 2. The rail 146 further includes a plurality of straps 150 that extend along the sidewall 144*c*, under the base surface 142 and up the sidewall 144*d* to connect to the rail 148. The straps 150 provide additional structural integrity to the bassinet 140. Specifically, when the curved inner radius of the hooks 146*a* and 146*b* engage the curved outer radius of the top link 190*c* and the hangers 148*a* and 148*b* similarly engage the top link 190*d*, the bassinet 140 is supported by the straps 150 and carried within the playard 180 (see FIG. 2).

The base surface 142 of the bassinet 140 and the base surface 182 of the playard 180 are typically a fabric layer suspended between their respective sidewalls. These base surfaces do not provide, nor are they typically intended to provide, the structural rigidity and support necessary to carry an infant or child occupant. Support is typically provided via the mattress pad assembly 100 when the multi-panel mattress pad 102 is received within the bassinet 140 and rests in contact with the base support 142 (see cutaway portion of FIG. 2). The mattress pad assembly 100 may further provide support for the base surface 182 of the playard 190 when, for example, the bassinet 140 is not in use and the infant or child is placed within the contained area defined by the sides walls 192.

The mattress pad 102, as previously discussed, is a multi-paneled mattress that includes a plurality of sections foldable but interconnected relative to one another along flexible seams 106. Each section or panel typically has a substantially rigid substrate adjacent to a bottom surface 108 of the mattress pad 102 and a padding or cushion layer adjacent to a top surface 110. In other embodiments, the rigid substrate and the padding may be separated by an inner liner layer (not shown). Each layer is sewn or otherwise secured within an outer sheath of material. The panels or sections are, in turn, sewn together within the outer sheath along the flexible seams 106 to form the integral mattress pad 102.

FIG. 2 illustrates a cutaway view of the bassinet 140 supporting the mattress pad assembly 100 and carried within the containment area defined by the playard 180. Alternatively, the bassinet 140 may be removed from the playard 180 and the mattress pad assembly 100 may be carried by the base surface 182 of the playard 180. The mattress pad assembly 100 may further include mechanisms, components and elements arranged to ensure that the top surface 110 remains substantially planar and flat when supporting an infant or child.

As used herein, the term "mattress pad assembly" generally identifies a number of embodiments configured to prevent bending and flexing of a mattress pad. Moreover, elements and components common to one or more embodiments are labeled utilizing common reference identifiers to facilitate comprehension.

Figure 3:
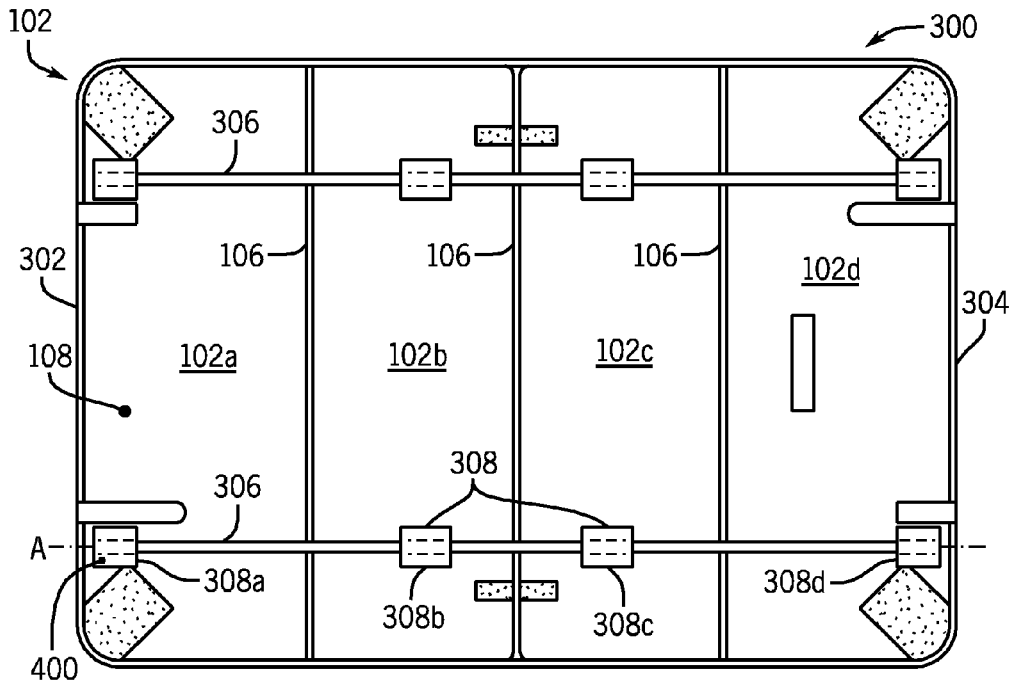
FIG. 3 illustrates a mattress support assembly that may be affixed to a bottom surface of a mattress pad.
Figure 4:
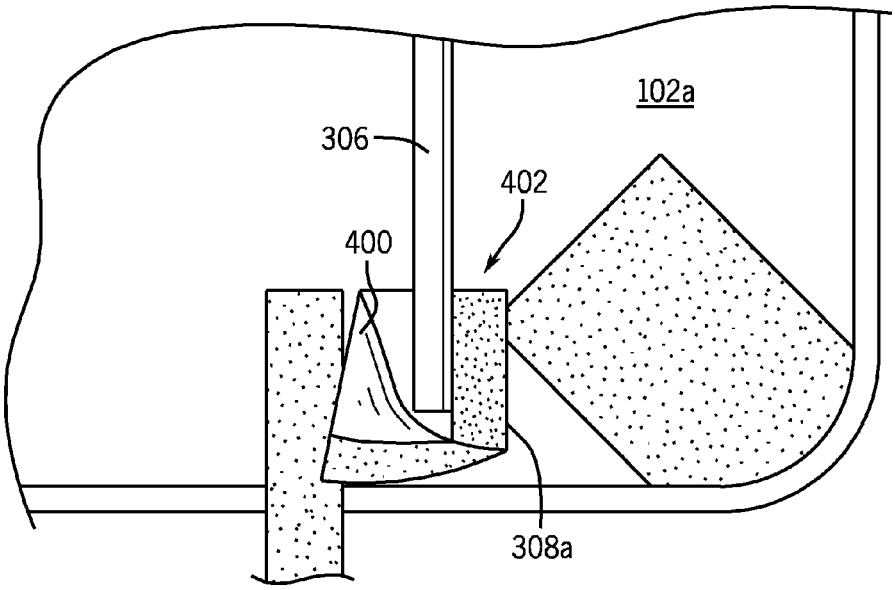
FIGS. 4 and 5 illustrate a resealable connector that may be utilized in connection with the mattress support assembly of FIG. 3.
Figure 5:
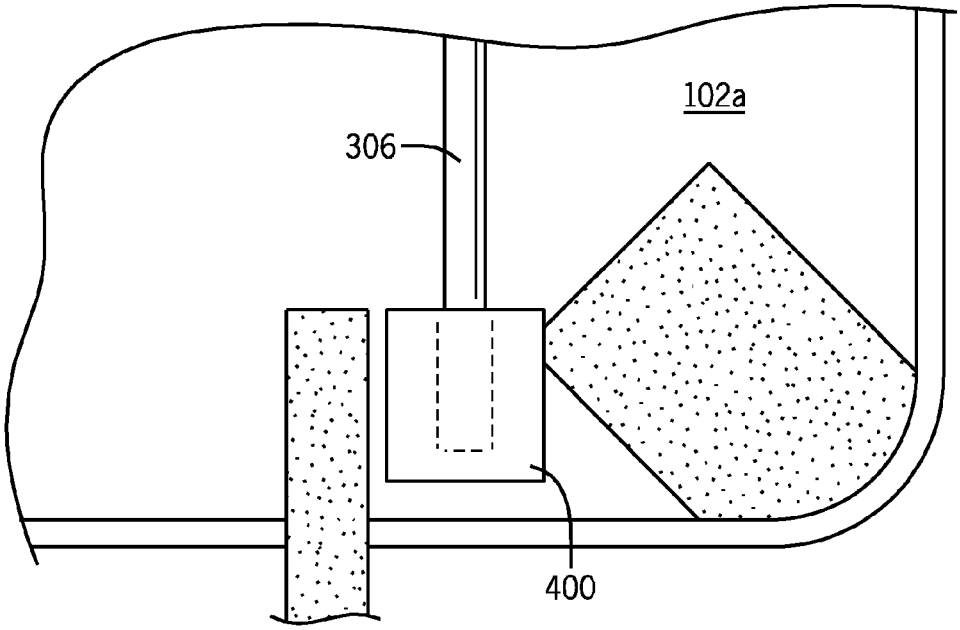

FIGS. 3, 4 and 5 illustrate an embodiment of a mattress pad assembly 100 constructed to maintain the mattress pad 102 and more specifically the top surface 110 of the mattress pad 102 in a flat configuration. FIG. 3 illustrates the bottom surface 108 of the mattress pad 102. The mattress pad 102 is shown to include four (4) panels individually identified by the references 102*a* to 102*d*. The four panels 102*a* to 102*d*, as previously discussed, are bound together by an outer sheath of material and bendable relative to each other along flexible seams 106. For example, when not in use, the mattress pad 102 may be folded along the flexible seams 106 to form a tube (not shown) sized to encompass a collapsed playard 180 (not shown). The tube may be constructed or formed by placing and holding a first edge 302 of the mattress pad 102 adjacent to a second edge 304.

Returning to the specific embodiment shown in FIG. 3, the bottom surface 108 of the mattress pad 102 is shown cooperating with a support assembly 300. The support assembly 300 includes a brace 306 and a plurality of connectors 308 affixed to the bottom surface 108 of the mattress pad 102 and arranged to cooperate with the brace. The brace 306 may be, for example, a hollow metallic tube, a plastic rod or any other structural component sized to extend between the first panel 102*a* and the last panel 102*d*.

The connectors 308 include a pair of loops 308*b* and 308*c* affixed to panels 102*b* and 102*c*, respectively. The loops 308*b* and 308*c* are aligned collinearly along a longitudinal axis indicated by the line A. The connectors 308 further include pockets 308*a* and 308*d* aligned collinearly with the loops 308*b* and 308*c*.

In operation, a first end of the brace 306 may be secured within the pocket 308*d* while the remaining length is threaded through the loops 308*b* and 308*c*. A second end of the brace 306 may be secured with the pocket 308*a* affixed to the first panel 102*a*. The pocket 308*a* may, as shown in FIGS. 4 and 5, be a resealable pocket having a fabric tab 400 that may be separated and reaffixed to the bottom surface 108 utilizing a fastening mechanism 402. The fastening mechanism 402 may be a mechanism such as VELCRO®, a mechanical zipper or clasp, one or more buttons or snaps or any other known or contemplated closure device. The illustrated embodiment utilizes VELCRO® to secure the pocket 308*a* around the second end of the brace 306 as shown in FIG. 5. In this way, the brace 306 can be removably affixed to the bottom surface 108 of the mattress pad 102 to prevent bending along each of the flexible seams 106.

Figure 6:
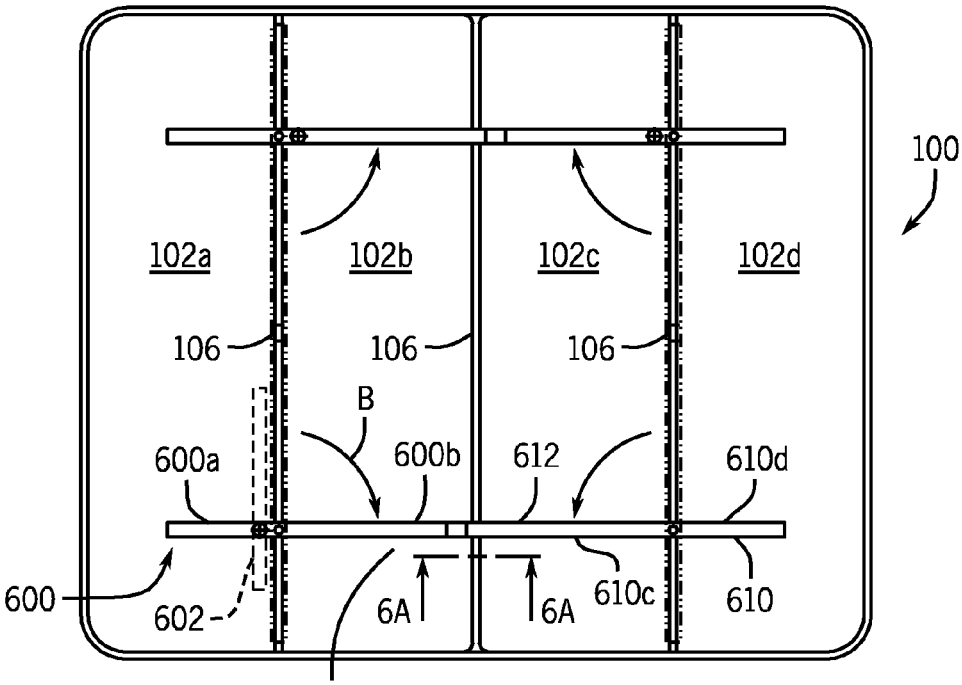
FIG. 6 illustrates another mattress support assembly including rotatable braces that may be affixed to a bottom surface of a mattress pad.
Figure 6A:
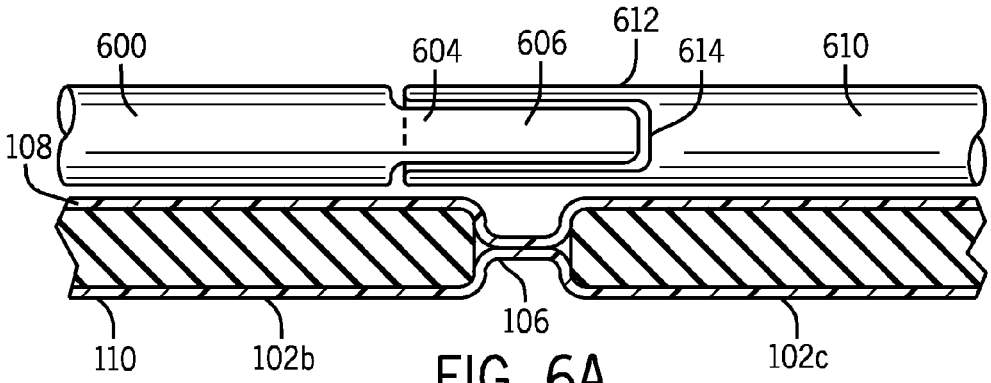
FIG. 6A illustrates an enlarged section view taken along the section line 6A-6A of the mattress support assembly shown in FIG. 6.

FIGS. 6 and 6A illustrates another embodiment of the mattress pad assembly 100 that utilizes a pivotable or rotatable brace 600 to prevent bending along each of the flexible seams 106. In this exemplary embodiment, the brace 600 is secured to the bottom surface 108 of the mattress pad 102 at a pivot point 602. The pivot point 602 may be any known fastener, rivet or screw that allows the brace 600 to rotate (as indicated by the arrow B) from a first position substantially parallel to the flexible seam 106 (shown as a dashed line in FIG. 6) to the illustrated second position substantially perpendicular to the flexible seam 106.

The brace 600 further includes tails or sections defined on either side of the pivot point 602. The sections are individually identified herein by the references 600*a* and 600*b*. When the brace 600 is disposed in the second position (as shown in FIG. 6) the section 600*a* cooperates with the panel 102*a* and the second section 600*b* cooperates with the panel 102*b* to prevent flexing or bending along the flexible seam 106. By way of contrast, when the brace 600 is aligned substantially parallel to the flexible seam 106, the panels 102*a* and 102*b* are free to bend and flex along the flexible seam 106.

The mattress pad assembly 100 may further include a complimentary brace 610 configured to cooperate with the brace 600 when both are arranged in the second position as show in FIG. 6. In particular, the relative lengths of the sections 610*c* and 610*d* may be selected to simultaneously engage the panels 102*c* and 102*d*, and to bring the tip 604 of the brace 600 into contact with the tip 612 of the brace 610.

FIG. 6A illustrates an enlarged cutaway view of the mattress pad 102 and the braces 600 and 610 adjacent to the flexible seam 106 defined between the panels 102*b* and 102*c*. In this embodiment, the tips 604 and 612 are shown to cooperate in a male-female mechanical arrangement. In particular, the tip 612 includes an open female compartment 614 sized to accept the male post 606 of the tip 604. The cooperation of the male post 606 and the female compartment 614 mechanically couples and/or locks the braces 600 and 610 together and further limit the possibility of flexure between the panels 102*a* to 102*d*.

In other embodiments, the male post 606 and the female compartment 614 utilize a friction fit to further secure the braces 600 and 610 together. A friction or interference fit requires the two components to be physically forced together to establish a secure coupling. In order to separate the braces 600 and 610, the components must be pulled apart to overcome the mechanical interaction therebetween. In this way, the braces 600 and 610 can be removably joined to prevent unwanted and/or unnecessary separation of the braces resulting in flexure of the mattress pad.

In yet other embodiments mechanical locks, spring loaded plungers and/or detents may be employed to mechanically join the braces 600 and 610 together. These mechanical locks may increase the component complexity and/or cost but provide additional security against an unwanted separation.

Figure 7:
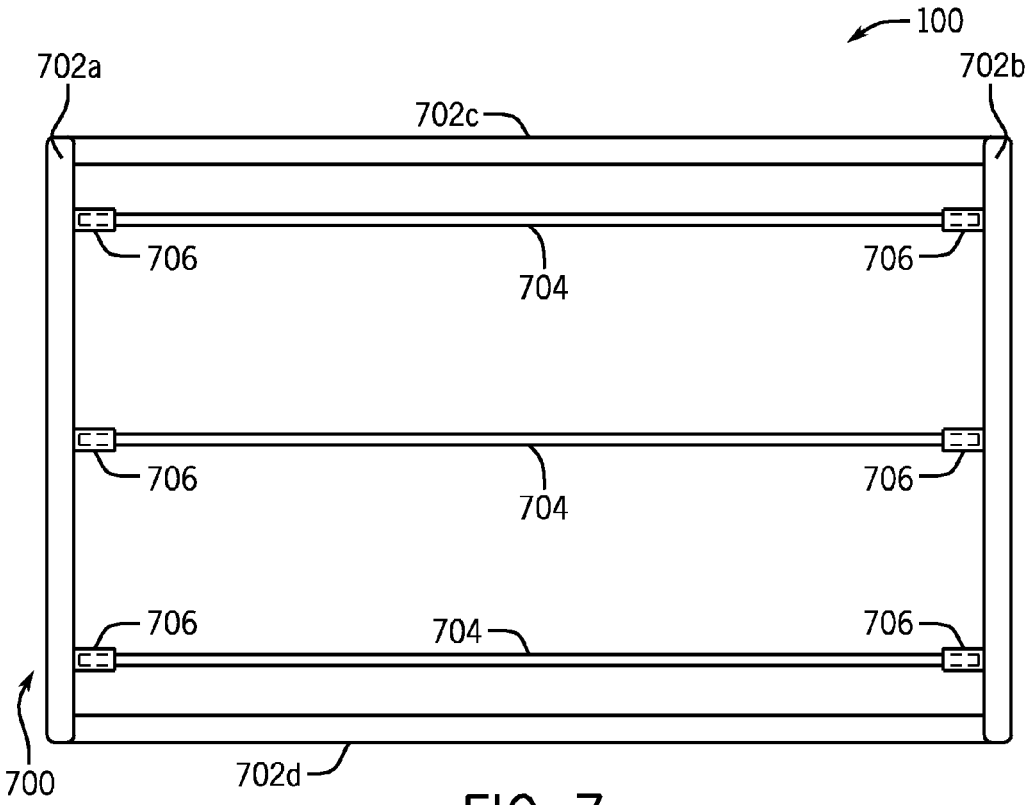
FIG. 7 illustrates another mattress support assembly including a support frame and braces that may be utilized in cooperation with a mattress pad.
Figure 8:
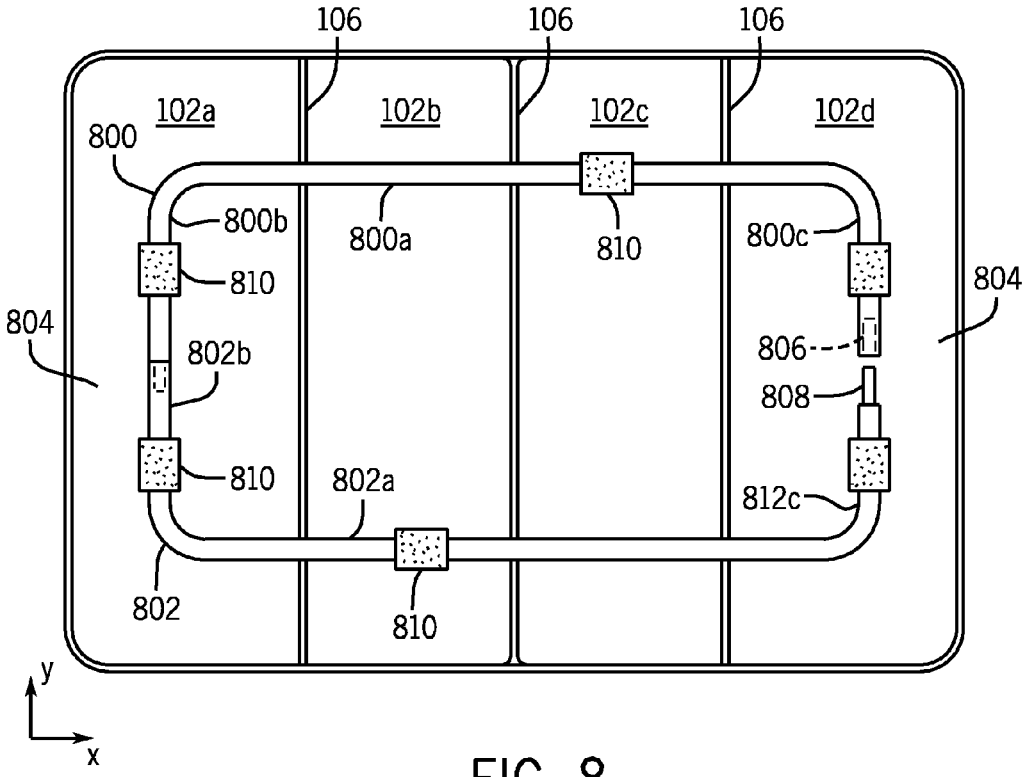
FIG. 8 illustrates another mattress support assembly including a pair of braces coupled to provide planar support of a mattress pad.
Figure 9:
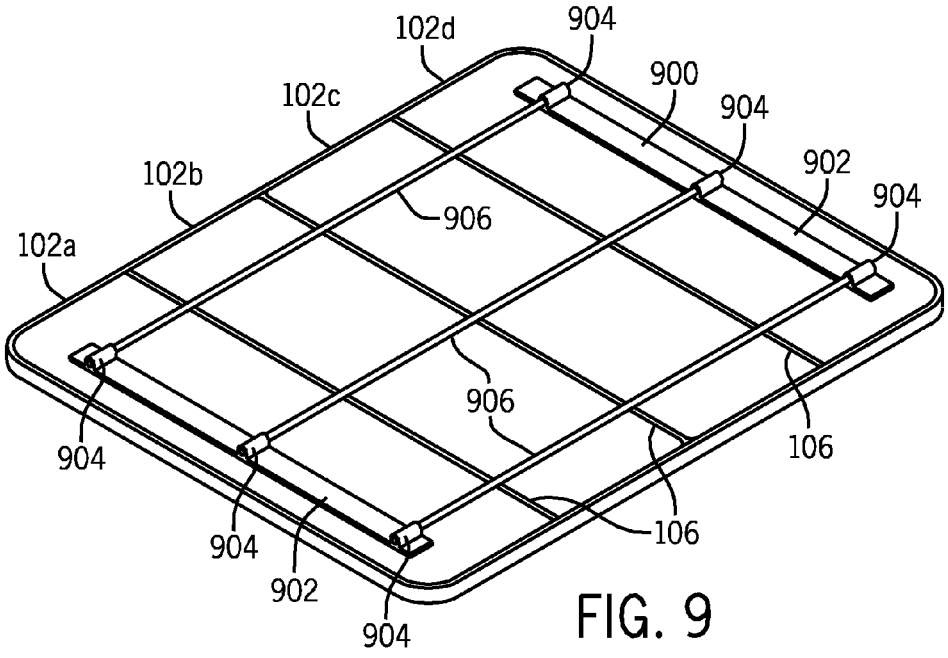
FIG. 9 illustrates another mattress support assembly including a pair of connectors affixed to a bottom surface of a mattress pad and configured to cooperate with a plurality of braces.

FIGS. 7, 8 and 9 illustrate other embodiments of the mattress pad assembly 100 configured to prevent flexure in the mattress pad 102. FIG. 7 illustrates a support frame 700 that may be utilized in connection with the mattress pad 102, the bassinet 140 and/or the playard 180. The support frame 700 is a substantially rectilinear frame sized to cooperate with, for example, a base surface 142 of the bassinet 140 or the base surface 182 of the playard 180. The support frame 700 includes support links 702*a* and 702*b* that compliment to the short sides of the rectilinear base surface 182, and support links 702*c* and 702*d* that compliment to the long sides of the rectilinear base surface 182. It will be understood by one of ordinary skill that the configuration and layout of the support frame 700 may be modified and adjusted to mirror or otherwise compliment to configuration of the bassinet 140 and/or the playard 180.

The support frame 700 may further include one or more brace 704 sized to extend the length of frame 700. For example, each brace 704 may be sized to extend substantially perpendicularly between the support links 702*a* and 702*b*. Thus, each of the braces 704 may be as long as the support links 702*c* and 702*d* in order to provide support along the length of the rectilinear support frame 700. Each brace 704 includes or cooperates with a connector 706 that fixedly attaches to the support links 702*a* and 702*b*. The connectors 706 may, in one embodiment, be permanently secured to the ends of the brace 704. In this configuration, the brace 704 and the attached connector 706 may fixedly or removably attach to the support link 702*a*. The opposing end of the brace 704 may similarly include another connector 706 to attach to the support link 702*b*. In yet another embodiment, one or more of the connectors 706 may be carried by the support links 702*a* and 702*b*. The brace 704 may, during an assembly or setup process, be coupled with the connector 706 to construct the support frame 700.

Once constructed, the support frame 700 may be supported within the containment area defined by the playard 180. The mattress pad 102 may, in turn, be placed upon and supported by the support frame 700. When the mattress pad 102 cooperates with support frame 700, the braces 704 evenly support each of the panels 102*a* to 102*d* and ensure or otherwise limit the flexure experienced by the top surface 110. The support frame 700 may be utilized in a like manner to provide additional support to the base surface 142 of the bassinet 140.

FIG. 8 illustrates another embodiment of the mattress support assembly 100 configured to provide planar support (i.e., support in both X and Y directions) to a mattress pad 102. In this exemplary embodiment, the mattress support assembly 100 includes a pair of substantially U-shaped braces individually identified by the reference numerals 800 and 802. The U-shaped braces 800 and 802 are each mirror images of the other. For example, the U-shaped brace 800 includes a base portion 800*a* and a pair of legs 800*b* and 800*c*. The base portion 800*a*, as shown in FIG. 8, extends between the panels 102*a* to 102*d* while the legs 800*b* and 800*c* extend parallel to the flexible seam 106 along the length of the panels 102*a* and 102*d*, respectively. The U-shaped brace 802 similarly includes a base portion 802*a* arranged substantially parallel to the base portion 800*a*. The legs 802*b* and 802*c* are arranged and aligned along the length of the panels 102*a* and 102*d* to cooperate with the legs 800*b* and 800*c*.

In use, the leg 800*c* is joined to the leg 802*c* via a lock 804 and the leg 800*b* is joined to the leg 802*b* via a second lock 804 arranged in similar albeit reversed configuration. For example, the leg 800*c* includes a pocket 806 sized to accept a post 808 portion of the leg 802*c*. By sliding the post 808 into the pocket 806, a mechanical connection (lock) 804 may be established between the braces 800 and 802. The leg 800*b* is also joined to the leg 802*b* but in this configuration the leg 800*b* includes the pocket 806 and the leg 802*b* includes the post 808. This configuration allows the legs 800 and 802 to be manufactured from a common mold and/or according to a common design and used with the lock elements of one brace reversed with respect to another.

When the brace 800 is coupled to the brace 802 via the lock 804, they cooperate to provide a two-dimensional frame capable of supporting the mattress pad 102. Specifically, the frame supports the bottom surface 108 of the mattress pad 102 and prevents each of the panels 102*a* to 102*d* from bending along the flexible seams 106 relative to others. In order to ensure that the braces 800 and 802 remain in contact, and therefore continue to support, the bottom surface 108; one or more loops 810 may be used to secure the frame to the bottom surface 108.

The loops 810 may be fabric or other flexible material affixed, riveted, screwed or otherwise attached to the bottom surface 108. Alternatively, the loops 108 may be removably attached via VELCRO®, a snap, a button or any other means or mechanism for releasably fastening the material of the loop to the bottom surface 108 of the mattress pad 102. In order to control the movement and ensure the flatness of the mattress pad 102, loops 810 are affixed to each of the panels 102*a* to 102*d* at one or more locations.

FIG. 9 illustrates another embodiment of the mattress support assembly 100 configured to mount to and cooperate with the mattress pad 102. In this exemplary embodiment, the mattress support assembly 100 includes a pair of connectors 900, each of which is affixed to one of the panels 102*a* and 102*d*. Each connector 900 may be a molded plastic connector that includes a plastic strip 902 which can be flushly affixed to the bottom surface 108. The connector 900 may further include a trio of hollow mounting cylinders 904 aligned perpendicular to the length of the plastic strip 902. The inner diameter of the mounting cylinders 904 may, in turn, be sized to accept a rod or brace 906.

In use, connectors 900 will be mounted to each of the panels 102*a* and 102*d* and aligned parallel to the flexible seam 106 connecting each to the adjacent panel. The mounting cylinders 904 on each of the connectors 900 are further aligned to support and carry one of the rods 906. In this manner, multiple rods 906 may be stretched and supported between the panels 102*a* and 102*d* to prevent the mattress pad from bending or flexing.

Figure 10:
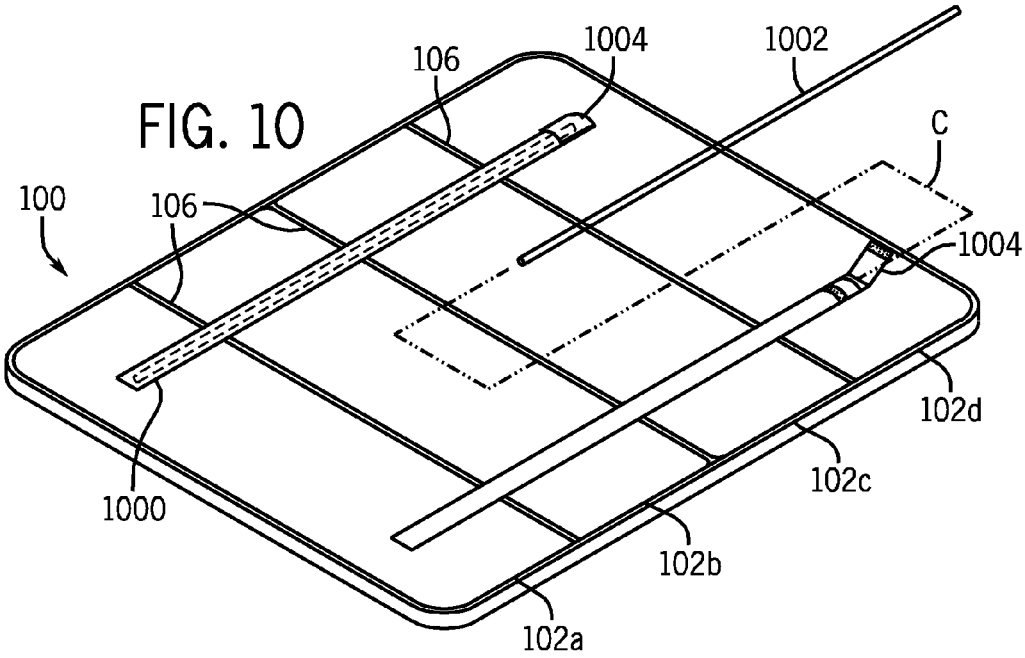
FIG. 10 illustrates another mattress support assembly including one or more pockets sized to accept a brace configured to support a bottom surface of a mattress pad.

FIG. 10 illustrates an embodiment of a mattress support assembly 100 that utilizes a pair of narrow pouches 1000 to carry a rod or brace 1002. Each of the narrow pouches 1000 will typically be constructed from a flexible material or fabric such as nylon or other synthetic polymer. In alternate configurations, the pouches 1000 may be constructed from the same material as the outer layer, formed as an integral portion of the outer layer or simply affixed or sewn into the outer layer.

Each of the pouches 1000 may further include a resealable flap 1004 to secure and contain the rod 1002 when it is inserted into an interior of the pouch as indicated by the line C. The length and width of the pouches 1000 can be varied based on the corresponding length and diameter (width) of the rod 1002. However, it is assumed that the length of the rod 1002 and the associated pouch 1000 are sufficient to prevent bending and flexing between any two panels along the flexible seam 106.

In the illustrated embodiment, the rod 1002 and the pouch 1000 are long enough to prevent bending relative to each of the panels 102*a* to 102*d* by preventing any movement along the three flexible seams 106. When the rod 1002 is removed from the pouch 1000, panels 102*a* to 102*d* are once again free to bend and move along the flexible seams 106.

Figure 11:
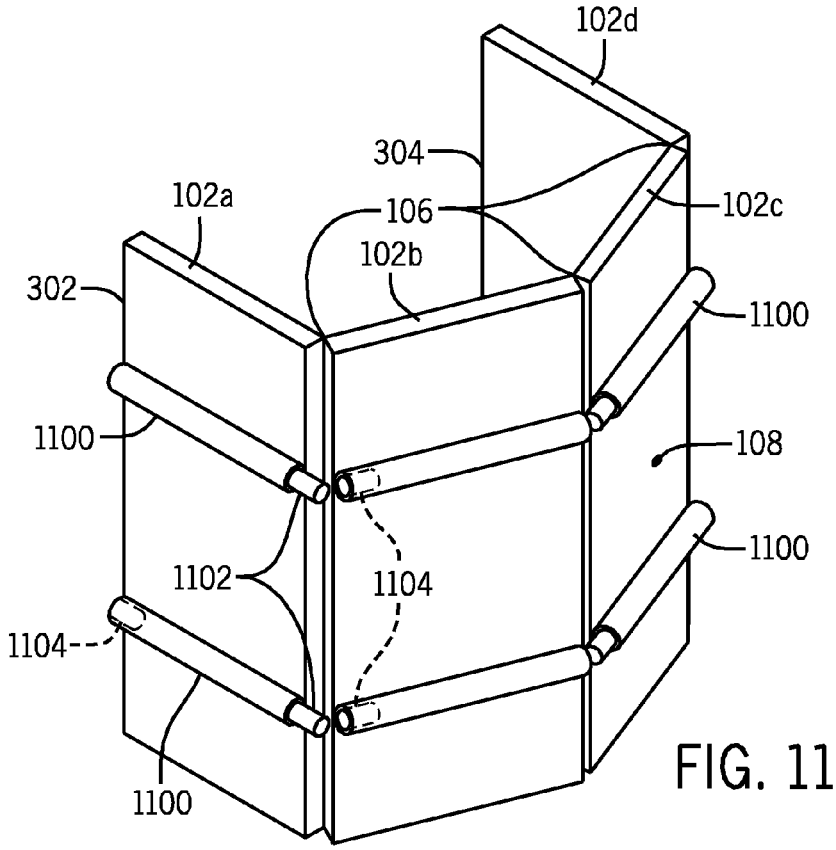
FIG. 11 illustrates another mattress support assembly including segmented braces that may be affixed to a bottom surface of a mattress pad.

FIGS. 11, 12 and 13A and 13B illustrate embodiments of the mattress support assembly 100 that utilize segmented braces and guides to facilitate transition of the mattress pad 102 from a deployed or in-use configuration to a stowed or travel configuration. FIG. 11 illustrates an exemplary mattress pad 102 in a partially stowed configuration characterized by the panels 102*a* to 102*d* bent relative to each other along the flexible seams 106. If the first edge 302 is brought into contact or proximity to the second edge 304, then the exemplary mattress pad 102 is considered to be in the stowed or travel position.

In the illustrated embodiment shown in FIG. 11, the bottom surface 108 carries and supports one or more brace segments 1100. The length of the individual brace segments 1100 roughly equals the width of one of the individual panels 102*a* to 102*d*. In this way, when the individual panels 102*a* to 102*d* are laid substantially flat, the brace segments 1100 can be assembled and joined to create a unified brace (not shown) that extends the length of the rectilinear mattress pad 102. The unified brace may be assembled by serially coupling the individual brace segments 1100 via the male-female connectors integral to each segment. For example, each of the individual brace segments 1100 may be formed or manufactured with a post 1102 at a first end and a socket 1104 at a second end. In order to assemble the unified brace, the post 1102 of the brace segment attached to panel 102*a* is inserted into the socket 1104 of the brace segment 1102 attached to panel 102*b*. The male-female cooperation of the post 1102 and socket 1104 portions of the brace segments 1100 is repeated until each of the panels 102*b* to 102*d* is coupled together via the unified brace. This assembly process may be repeated for any number of brace sections attached to the bottom surface 108 of the mattress pad 102. Moreover, the process may be reversed by removing each of the posts 1102 from a corresponding socket 1104 to thereby allow the panels 102*a* to 102*d* to flex and bend along the flexible seam 106.

Figure 12:
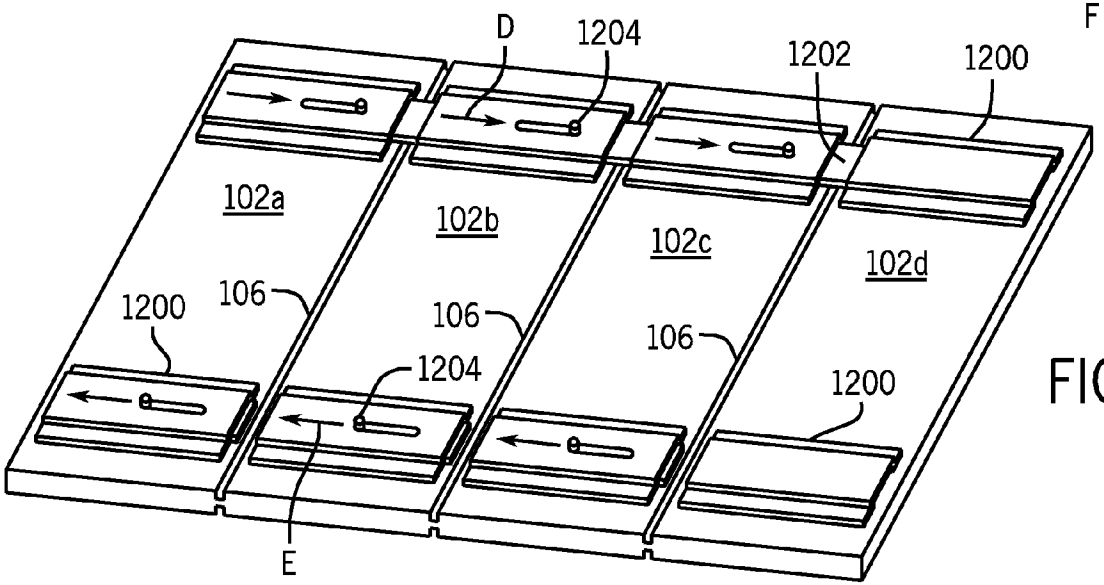
FIG. 12 illustrates another mattress support assembly including a plurality of c-tunnels and segmented braces that may be affixed to a bottom surface of a mattress pad.

FIG. 12 illustrates an embodiment of the mattress support assembly 100 that utilizes a substantially flat guide or c-tunnel 1200 affixed to the bottom surface 108 of the mattress pad 102. In particular, each of the panels 102*a* to 102*d* supports one or more c-tunnels 1200 that extend the width of the panel (i.e., the distance between the flexible seams 106 that define each panel). The c-tunnel 1200, in turn, encloses and guides a slideable brace 1202 that may be moved between an in-use position and a stowed position. For example, the slideable brace 1202 associated with the panel 102*a* may be manually moved via the handle 1204 (as indicated by the arrow D) to cooperate with an adjacent c-tunnel 1200 affixed to the panel 102*b*. In this position, the two c-tunnels 1200 and the slideable brace 1202 prevent bending along the flexible seam 106 thereby holding the panels 102*a* and 102*b* in a planar configured with respect to each other. Similarly, by using the handle 1204 to retract the slideable brace 1202 into the c-tunnel 1200 affixed to the panel 102*a* (as indicated by the arrow E), the panel 102*b* may be moved relative to the panel 102*a*.

The configuration illustrated in FIG. 12 allows each of the slideable braces 1202 to cooperate with an adjacent c-tunnel 1200 in order to lock or otherwise hold the mattress pad 102 in a flat configuration. When each of the handles 1204 are used to disengage the slideable brace 1202 from the adjacent c-tunnel 1200 by moving it in the direction indicated by the arrow E, the mattress pad 102 may be released or unlocked from the flat configuration for storage or transport.

Figure 13A:
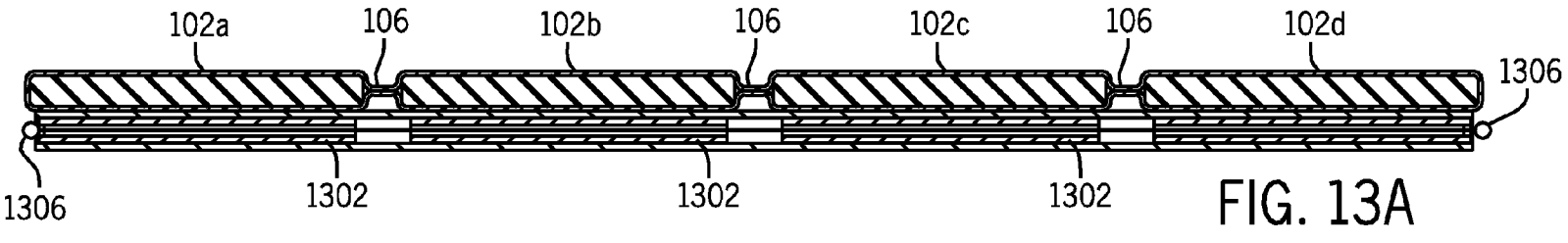
FIGS. 13A and 13B illustrates another mattress support assembly including a sheath and segmented braces coupled via a pull tab that may be affixed to a bottom surface of a mattress pad.
Figure 13B:
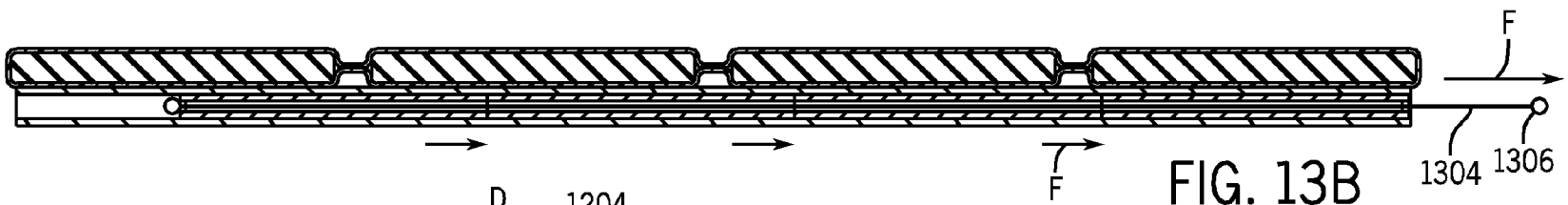

FIGS. 13A and 13B illustrate another embodiment similar to the configuration illustrated in FIG. 12. In the embodiment shown in FIGS. 13A and 13B, the mattress support assembly 100 replaces the individual c-tunnels 1200 with a flexible sheath 1300. The flexible sheath 1300 supports a plurality of braces 1302 adjacent to the bottom surface 108 of the mattress pad 102. The braces 1302 are free to move and/or slide within the shealth 1300 between an unlocked or flexible position shown in FIG. 13A and a locked or flat position shown in FIG. 13B. The movement of the braces 1302 between the locked and unlocked positions is controlled by a pull tab 1304 that extends through each of the braces 1302. The pull tab 1304 contains each of the braces 1302 between a pair of retainers of knobs 1306. In particular, when the mattress support assembly 100 is in the free or unlocked position, the braces 1302 are allowed to slide freely along the pull tab 1304. Because the braces 1302 are not constrained, the panels 102*a* and 102*d* are free to bend and flex along the flexible seams 106. When the pull tab 1304 is forced in the direction indicated by the arrow F, the braces 1302 are engaged by the retainer 1306 and pulled along as well. As the retainer 1306 engages the braces 1302, the braces 1302 move relative to the pull tab 1304 and the panels 102*a* and 102*d* to the locked position. In the locked position, as shown in FIG. 13B, the braces 1302 are positioned in continuous contact with each other thereby preventing movement or bending along the flexible seam 106. In this way, any slack between the braces 1302 can be removed by the cooperation of the retainer 1306 and the pull tab 1304. To reverse the process and unlock braces 1302 the pull tab 1304 moved in the opposite direct (i.e., shaken out) to reintroduce slack between the braces. In other embodiment, the position of the braces 1302 may be fixed relative to the pull tab 1304 and the mattress pad 102 may be locked by simply changing the alignment of the braces 1302 relative to the flexible seams 1306.

Figure 14:
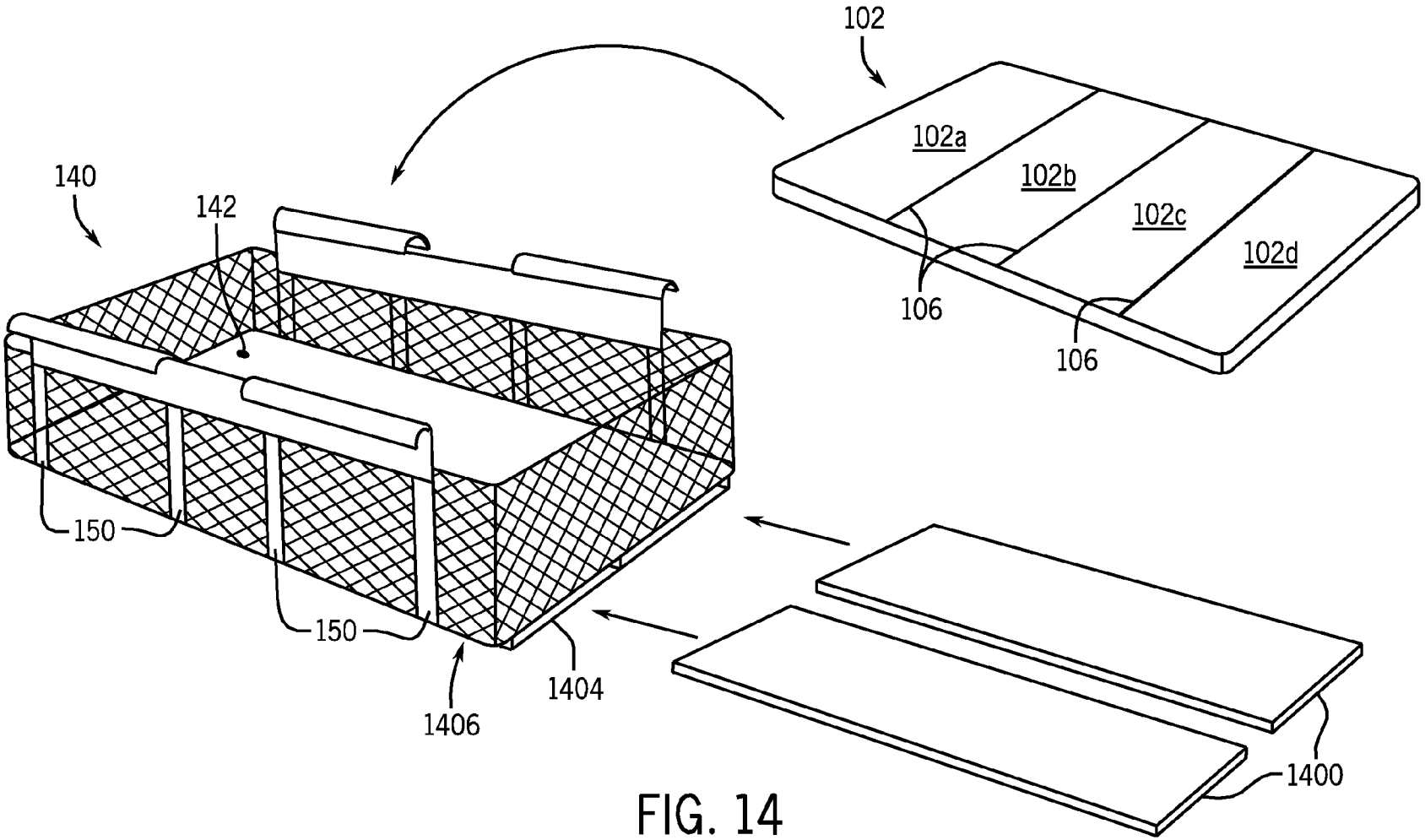
FIG. 14 illustrates another mattress support assembly including one or more planar supports configured to cooperate with a bottom surface of a bassinet.

FIG. 14 illustrates another embodiment of the mattress support assemble 100 that includes slideably or removeably mounting one or more support panels 1400 relative to the base surface 142 of the bassinet 140. In particular, one or more pockets or sheaths 1404 may be secured to a bottom side 1406 of the bassinet 140. Each of the pockets or sheaths 1404, in turn, may be configured to carry the support panels 1400 to provide additional structural support and integrity to the bassinet 140. In this way, when the mattress pad 102 is positioned on the base surface 142, the panels 1400 provide complete support and prevent bending along the flexible seam 106.

When the support is no longer required, the panels 1400 may be removed and the bassinet 140 folded or otherwise configured for storage and travel.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A mattress pad assembly for use with a child containment area, the mattress pad assembly comprising:

a mattress pad having a plurality of panels each of which is coupled to at least one other panel along a flexible seam, wherein the mattress pad is reconfigurable between a non-planar configuration and a planar configuration defined by the cooperation of the plurality of panels to form a flexible top surface and a substantially rigid bottom surface; and a first brace secured adjacent to the flexible seam, wherein the first brace is rotatable between an aligned position parallel to the flexible seam and an in-use position that prevents bending along the flexible seam.

2. The mattress pad assembly of claim 1 further comprising:

a second brace secured adjacent to a second seam, wherein the second brace aligns with the first brace when each is in the in-use position.

3. The mattress pad assembly of claim 2 further comprising a lock defined between the first brace and the second brace when both braces are rotated and aligned in the in-use position.

4. The mattress pad assembly of claim 3, wherein the lock defines a male-female engagement mechanism.

5. The mattress pad assembly of claim 3, wherein the lock includes a tip portion of the first brace configured to mechanically cooperate with a compartment formed within a tip portion of the second brace.

6. The mattress pad assembly of claim 1, wherein the brace comprises a substantially rigid rod.

7. The mattress pad assembly of claim 1, wherein the first brace is configured to cooperate with a bassinet when the bassinet is coupled to the child containment area, the mattress pad being configured for the bassinet.

* * * * *